United States Patent [19]

Gonzalez-Alvarez et al.

[11] Patent Number: 4,829,610

[45] Date of Patent: May 16, 1989

[54] BED CONVERTIBLE INTO ESPALIERS FOR THE PRACTICE OF GYMNASTICS

[76] Inventors: Cesar Gonzalez-Alvarez, Gral. Vives 45 2a, Ponferrada; Juan Gonzalez-Alvarez, Los Naranjos 42 3o 3a, Hospitalet Llobregat, both of Spain

[21] Appl. No.: 61,737

[22] Filed: Jun. 11, 1987

[30] Foreign Application Priority Data

Jun. 11, 1986 [ES] Spain ..... 295115[U]

[51] Int. Cl.[4] ..... A47B 83/00; A47C 19/06

[52] U.S. Cl. ..... 5/2 R; 5/136; 5/160; 182/34

[58] Field of Search ..... 5/2 R, 133, 136, 159 R, 5/160, 162, 163, 137–144; 182/34, 35; 272/62, 109

[56] References Cited

U.S. PATENT DOCUMENTS

| | | | |
|---|---|---|---|
| Re. 13,736 | 5/1914 | Mulvaney | 5/160 |
| 261,305 | 7/1882 | Burr | 5/160 |
| 1,142,137 | 6/1915 | Bathrick | 272/109 X |
| 2,257,625 | 9/1941 | Thomas | 5/136 X |
| 2,607,046 | 8/1952 | Driver | 5/2 R |
| 4,234,979 | 11/1980 | Bergerud | 5/133 |
| 4,245,838 | 1/1981 | Gordon . | |
| 4,477,070 | 10/1984 | Appelbaum . | |
| 4,616,370 | 10/1986 | Keenan et al. | 5/2 R |
| 4,679,787 | 7/1987 | Guilbault | 5/136 X |

FOREIGN PATENT DOCUMENTS 8700065 1/1987 PCT Int'l Appl. .

*Primary Examiner*—Gary L. Smith
*Assistant Examiner*—Michael F. Trettel
*Attorney, Agent, or Firm*—Frijouf, Rust & Pyle

[57] ABSTRACT

It comprises a frame which consists of two stringers joined by a plurality of spaced bars, which are articulated by at least an intermediate area which allows the take down of a track against the contiguous one to fold the frame, through one end they are articulated to some supporting feet fastened on the floor which correspond to the area of the head of a bed, on which frame is supported the framework of a bedspring or similar which supports the corresponding mattress. The frame may adopt two main positions, a horizontal and folded position to act as a bed, and a vertical extended position to act as exercise frame for the practice of gymnastics.

8 Claims, 3 Drawing Sheets

BED CONVERTIBLE INTO ESPALIERS FOR THE PRACTICE OF GYMNASTICS

FIELD OF THE INVENTION

The present invention refers to a bed convertible into an exercise frame for the practice of gymnastics.

BACKGROUND OF THE INVENTION

As it is known, there are several types of convertible beds, which may be used as bed, sofa, bookcase, etc. Up till now, not any bed is known that may be also used for gymnastics. To practice gymnastics, the user must go to a gymnasium and that implies additional expense and inconvenience of traveling to the gymnasium. Thus, the user cannot practice gymnastics at any time he may wish.

The above mentioned expense and inconveniences have been favourably eliminated with a bed convertible into espaliers for the practice of gymnastics. Therefore it is an object of the present invention, to provide a bed for making available an exercise frame to practice gymnastics comfortably at home. The advantage of the invention comprising a bed convertible into espaliers are available for practically the same price as a conventional bed.

The bed convertible into an exercise frame for the practice of gymnastics is characterized in that it comprises a frame which consists of two spaced apart stringers or supports which are interconnected by a plurality of spaced bars. The stringers are articulated in at least an intermediate area which allows the take down of a track against the contiguous one to fold the frame. The stringers are also articulated to support feet which in use are fastened on the floor which correspond to the area of the head of the bed, over which the frame is supported. The stringers are also articulated at the supporting feet, the frame of a bedspring or similar which supports the corresponding mattress, so that the frame may adopt two main positions. A horizontal and folded position to act as a bed, in which at one end the frame is articulated to the supporting feet and on the other end, the bed is supported on the floor by means of legs solidary of the ends of the stringers folded on themselves and keeping the mattress above the bedspring. A vertical extended position to act as an exercise frame for the practice of gymnastics, after the upward oscillation of the bedspring with the mattress being kept in position, in which the stringers are extended in prolongation, and are firmly held in said position by means of the disposition of anchoring means between the stringers and the supporting feet and between the contiguous articulated tracks of the stringers.

In preference, the ends of the stringers incorporate U shaped flanges provided with a hole for the passing of the articulation axle and as aperture formed in each stringe for the disposition of the anchoring element. The supporting feet at both sides of the frame may be firmly joined in making a kind of framework as described below. The frame presents at the top rear prolongations in which are articulated, directly or indirectly, by means of supplements, the sides of the frame of the bedspring or similar.

DETAILED DESCRIPTION

In accordance with the drawings, the mode of performance which is described comprises an exercise frame, identified in general with -1-, made up by two stringers -2- and a plurality of bars -3- transversely joined to the stringers on a spaced position. The stringers on each side are coupled by anchoring at one end between the branches of the U shaped flange -4- to which intermediate area of the U is joined a small plate **-4*a*- presenting a hole -4'*a*- which incorporates the adequate bearing—not illustrated—in which is mounted the corresponding articulation axle -5- and an aperture -22- for the disposition of an anchoring pin -21-** to provide a locking means, as described hereinafter, to keep the frame in the vertical position.

Figure 1:
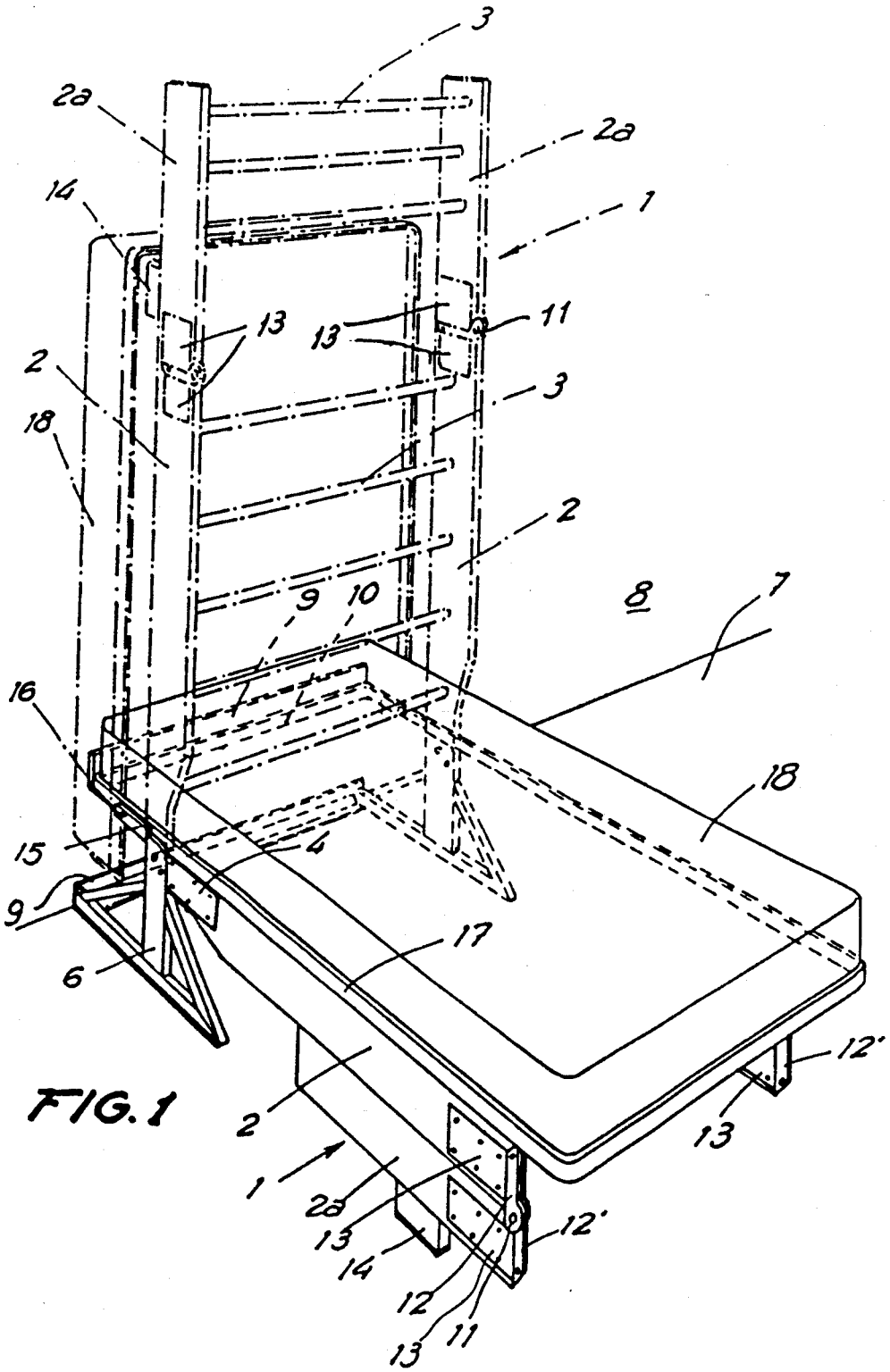
FIG. 1 is a perspective view which illustrates the furniture object of the present invention, on a continuous trace acting as a bed and on a discontinuous trace acting as espaliers.

By means of the axle -5-, the stringers -2- at each side of the frame are articulated to respective side feet -6- for support on the floor -7- provided with the corresponding reinforcements and braces **-6*a*-, -6*b*-, -6*c*-. Both supporting feet -6- comprise a stand 7*a* are fastened on the floor close to the wall -8- of the room where the bed is positioned, by means of an L shaped crosspiece -9- which relates in between the two cited feet -6- on the sides, making up a kind framework to provide further strength to the assembly. The crosspiece -9- is adjusted in the angle made by the floor -7- and the wall -8- cited, at which angle area are applied screws or equivalent objects -9'- passing through holes provided on a plate or the like -10- welded between the wings of the crosspiece -9-, which screws or similar objects are coupled in plugs or the like built-into said angle area made up between floor -7- and the wall -8-. Likewise, said stringers -2- of frame -1- of the bed are articulated in between in an intermediate area in correspondence with the footpiece of the bed, by means of an articulation axle -11- through respective U shaped flanges -13- coupled by anchoring between the corresponding branches of the U, not only to the opposite ends to which the flanges are coupled -4- but also to the contiguous ends of the end tracks -2*a*- of said stringers, to one of which flanges -13- is joined by the intermediate area of the U two small plates -12-, -12- on the sides. One only small plate -12'- is joined by the intermediate area of the U and central to the other flange -13-, which small plate, in the mounting, is located between the small plates -12-. The small plates -12-, 12'- and -12- are provided with holes which are coincident for the passing of the cited articulation axle -11-. The axle -11-, is mounted on a bearing—not illustrated—established in the hole of the intermediate small plate -12'-, and is held in position between the holes of the two other small plates -12-, -12- which allows the take down of the articulated tracks of the stringers, the folding of the frame -1- as indicated in FIGS. 1 and 2, and that the frame may be supported in horizontal position on the floor -7- by means of two legs -14- respectively provided at the the tracks -2*a*- with the stringers and which cooperate with the supporting feet -6-**.

Figure 3:
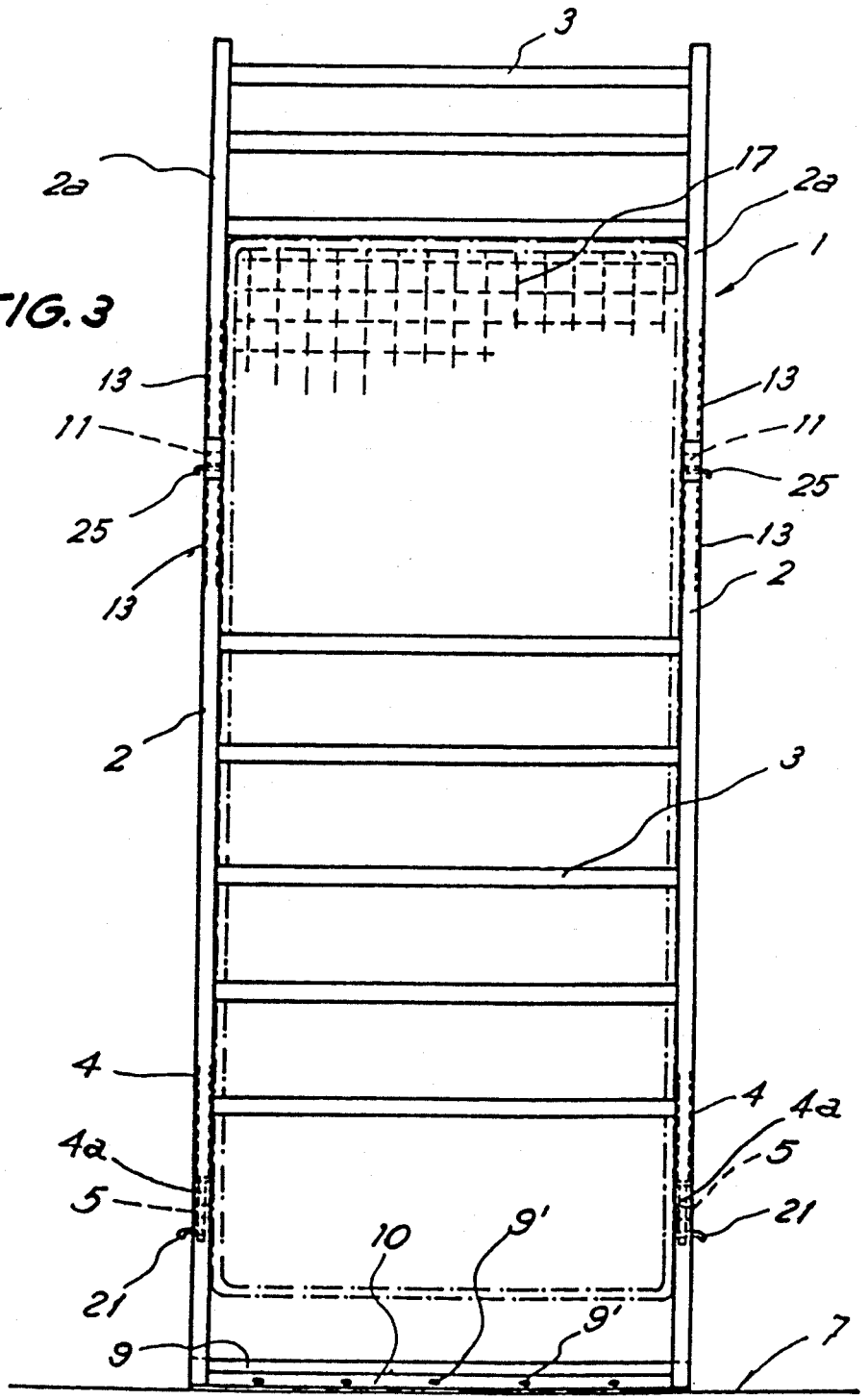
FIG. 3 represents a front elevation view of the position of the furniture for its use as an exercise frame.

From the supporting feet -6- overlap on the top rear L shaped arms -15- to which arms, by means of an axle -16- are articulated the side longitudinal tracks of a bedspring bed frame -17- of any conventional type and width, be it in lamé or springs, as schematically illustrated in FIG. 3 or a frame with a table or the like. The bedspring -17- is supported on the frame in at least the part of the footpiece. On the bedspring -17- is established a mattress -18- which, at its end corresponding to the head of the bed is applied against a top plate -19- solidary to the bedspring -17- which, at the cited horizontal position of the frame -1-, is supported, directly or indirectly, through supplements, to the stringers -2-, which makes possible the use of the furniture as a bed.

Figure 2:
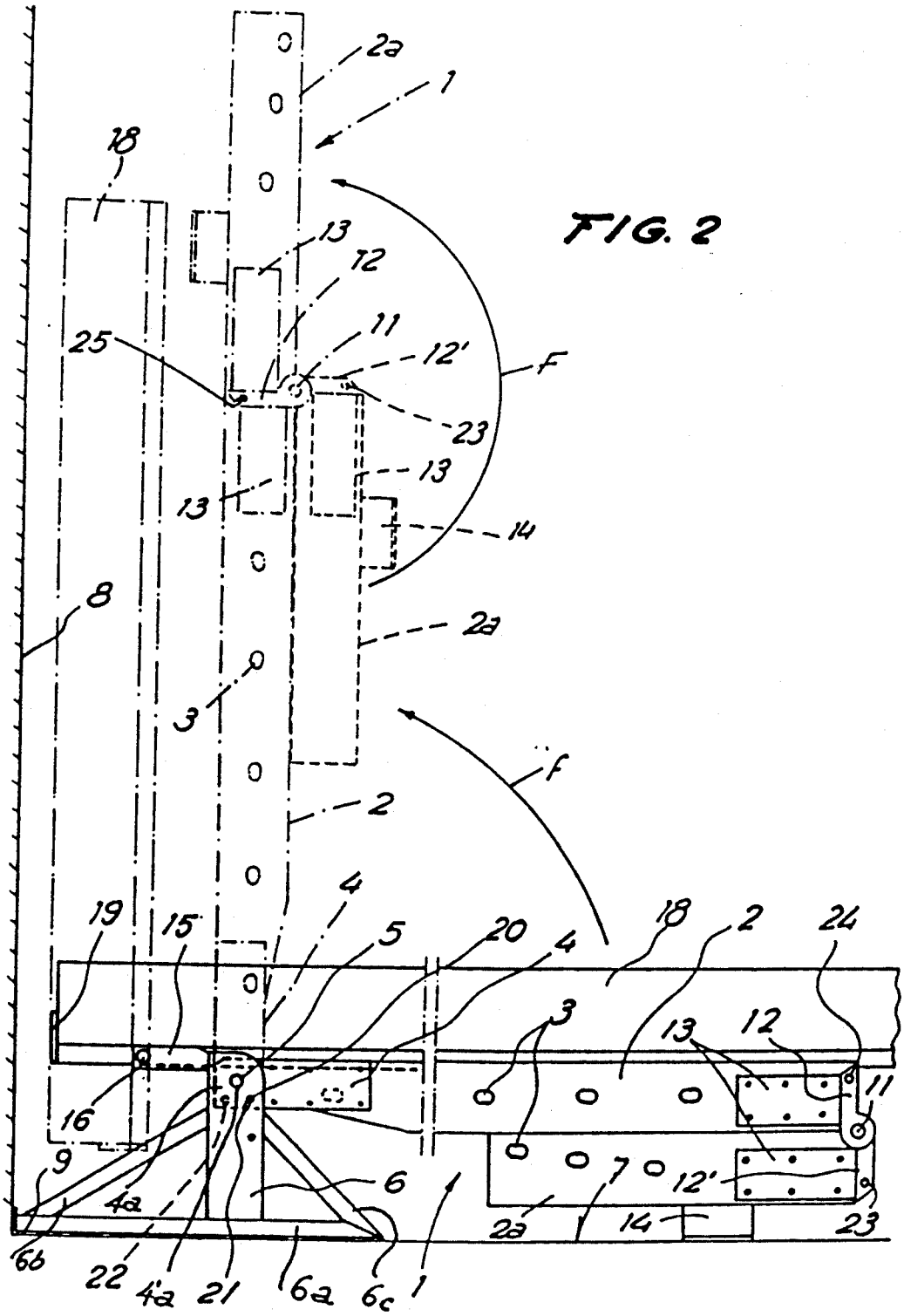
FIG. 2 corresponds to a side elevation view which illustrates on a continuous trace the position of use as a bed and on a discontinuous trace the position of use as an exercise frame.

The establishment of the frame -1- on basis of stringers -2-, articulated, allows the frame to go from the horizontal position described in which it acts as a conventional bed, to the vertical position in which it may act as an exercise frame for the practicing of gymnastics, the change of position is made by mere oscillation as per the arrow -F- in FIG. 2 regarding the axle -5-, previously tilting the bedspring -17- with the mattress -18- which is held in position by means of the top plate -19-, besides other conventional means used in take-down beds. Now then, to keep the frame in the verticl folded over position, the supporting feet -6- are provided with aperture -20- and the small plates -4*a*'- of the flanges -4- coupled to the stringers -2- are provided with respective apertures -22- as previously described. Thus, in the horizontal position of the frame the apertures -20- and -22- are not coincident, for which the apertures -22- of the stringers are hidden and are represented on a discontinuous trace in FIG. 2, whilst in the vertical position both apertures -20- and -22-, are coincident and allow the disposition of an anchoring pin -21- on each side, to keep the frame in the vertical position. Likewise, the two tracks of the stringers -2- are extended in prolongation in the vertical position to avail of another anchoring pin -25- in the apertures -23- and -24- coincident with the small plates -12-, -12'- and -12- provides a securing means to maintain the vertical position, as already indicated.

Of course, the number of articulated tracks of the stringers may be any number desired to reduce the length of the frame in the horizontal position, independently that in the illustrated performance, the frame comprises two articulated tracks only. The frame of the bedspring may be of any articulated type and may also be foldable, with which the frame with the bedspring and the mattress may adopt a third position of utmost folding hidden in a furniture, wardrobe or the like, with which the space occupied is minimal, like that of any bed furniture that may be hidden, in a way that the frame may occupy the following positions: hidden, like a bed and vertical like an exercise frame.

It must be highlighted that though in the drawings and in the description are illustrated the two supporting feet -6- solidary in between like a framework, the present invention provides their being independent, and it may also present a configuration cifferent from the one illustrated.

On its part, it is neither absolutely necessary that the flanges for the articulation of the stringers in between and to the supporting feet, present a U configuration and incorporate the cited small plates joined in its intermediate area, as the flanges may be, for instance, straight or in the mode of a Z, or even the cited articulation may be performed by making a passing drill in the very stringers, or fastening to same bridge elements for the passing of the articulation axle.

With respect to the bedspring, it may be articulated at the supporting feet directly as illustrated in the drawings through the prolongations -15- of the very supporting feet, or indirectly through some rear prolongations of the stringers, coadjuvating to the tilting of the frame.

In the same way, the anchoring means in the vertical position as an exercise frame may be of a manual type with the pins -21- as illustrated, or in an automatic mode, to avoid efforts, in combination with which, to the frame may be associated pressure means and/or dampering means to facilitate the lift and descent of same without any effort on the part of the user.

Likewise, the cited isposition allows that, as illustrated in the supporting feet -6-, any traditional headpiece may be adapted, and even that any footpiece, conventional, may be adapted, with which the aspect of the present convertible ben when acting as such may be that of any traditional bed.

In the same way, it can be held hidden in a wardrobe in the vertical position so that it occupies little space.

Analogously, the number of bars that may present the stringers may be and convenient ne, and it must be stated that the upper bar -3- (FIG. 2) to facilitate the lifting with the bands, must be a little frontally moved regarding the illustrated position.

We claim:

1. A convertible bed, comprising:

an exercise frame having two spaced supports interconnected by a plurality of bars arranged at spaced intervals along said supports;

a stand which rests upon a supporting surface in use;

said exercise frame being joined to said stand for pivotal movement relative to said stand between a vertical position and a horizontal position;

locking means for retaining said exercise frame in said vertical position;

a bed frame attached to said exercise frame for supporting a mattress with said bed frame being disposed above said exercise frame when the latter is in the said horizontal position; and wherein each said support includes an articulated track section to enable said exercise frame to be folded for storage when said exercise frame is placed in said horizontal position.

2. The convertible bed of claim 1, wherein said exercise frame includes securing means for locking said tracks to prevent movement of said tracks relative to said stand when said exercise frame is placed in said vertical position.

3. The convertible bed of claim 2, wherein each articulated track of said exercise frame is positioned remote from said stand; and each articulated track being articulatable into a position wherein each track lies beneath the remainder of said exercise frame when said exercise frame is in said horizontal position, thereby providing support for a part of said bed frame remote from said stand.

4. The convertible bed of claim 3, wherein each articulated track further includes a leg for engaging the supporting surface.

5. The convertible bed of claim 2, wherein said securing means comprises a plurality of anchoring pins, with one anchoring pin of said plurality of anchoring pins being received into each aperture of a plurality of apertures alignedly formed in each articulated track and aligned formed in each support of said exercise frame.

6. The convertible bed of claim 1, wherein said locking means comprises a plurality of anchoring pins, with one anchoring pin of said plurality of anchoring pins being received into each aperture of a plurality of apertures alignedly formed in each spaced support of said exercise frame and alignedly formed in said stand.

7. The convertible bed of claim 1, wherein each said articulated track is positioned remote from said stand; and each said articulated track of each said support of said exercise frame is articulatable into a position wherein each said track lies beneath the remainder of said exercise frame when said exercise frame is in said horizontal position, thereby providing support for a part of said bed frame remote from said stand.

8. A convertible bed as claimed in claim 7, wherein each said track is provided with a leg for engaging the supporting surface.

* * * * *